US011710612B2

(12) United States Patent
Quintana Ramos et al.

(10) Patent No.: US 11,710,612 B2
(45) Date of Patent: Jul. 25, 2023

(54) MOLDED CASE CIRCUIT BREAKER WITH TERMINAL COVER HAVING EMBOSS GUIDES FOR CABLE BOX COVER ALIGNMENT AND FIXING

(71) Applicant: Siemens Industry, Inc., Alpharetta, GA (US)

(72) Inventors: Luis Fernando Quintana Ramos, Monterrey (MX); Carlos Andres Espinosa Perez, Garcia (MX); Ismael Francisco Morales Trevino, Garcia (MX)

(73) Assignee: Siemens Industry, Inc., Alpharetta, GA (US)

( * ) Notice: Subject to any disclaimer, the term of this patent is extended or adjusted under 35 U.S.C. 154(b) by 211 days.

(21) Appl. No.: 17/320,753

(22) Filed: May 14, 2021

(65) Prior Publication Data

US 2022/0367136 A1 Nov. 17, 2022

(51) Int. Cl.

| | |
|---|---|
| ***H01H 9/02*** | (2006.01) |
| ***H01H 71/40*** | (2006.01) |
| ***H01H 71/08*** | (2006.01) |
| ***H01H 71/02*** | (2006.01) |
| ***H01H 71/74*** | (2006.01) |

(52) U.S. Cl.

CPC ..... *H01H 71/40* (2013.01); *H01H 71/0264* (2013.01); *H01H 71/08* (2013.01); *H01H 71/7463* (2013.01)

(58) Field of Classification Search

CPC .... H01H 71/40; H01H 71/0264; H01H 71/08; H01H 71/7463

USPC ..... 335/202

See application file for complete search history.

(56) References Cited

U.S. PATENT DOCUMENTS 5,258,729 A * 11/1993 Link ..... H01H 71/0228 335/8
5,258,733 A * 11/1993 Link ..... H01H 71/2472 335/172
5,266,760 A * 11/1993 Link ..... H01H 71/0257 200/244
5,278,531 A * 1/1994 Link ..... H01H 9/342 335/8
5,341,191 A * 8/1994 Crookston ..... H01H 77/107 218/32

(Continued)

*Primary Examiner* — Shawki S Ismail
*Assistant Examiner* — Lisa N Homza

(57) ABSTRACT

A molded case circuit breaker configured to protect its ports and cables is provided. The molded case circuit breaker comprises an electronic trip unit (ETU) including communication ports or a thermomagnetic trip unit (TMTU). The molded case circuit breaker further comprises a terminal cover configured to pass cables that connect to the communication ports of the ETU and pass the cables over lugs without touching the lugs. The molded case circuit breaker further comprises a cable box cover that protects the cables of the ETU from external harm. The terminal cover including an emboss fixture having emboss guides for alignment and fixing of the cable box cover. The electronic trip unit (ETU) or the thermomagnetic trip unit (TMTU) and the cable box cover are assembled with one or more screws. The cable box cover is prevented from falling after the one or more screws are taken out from the terminal cover regardless of how the circuit breaker is mounted.

12 Claims, 5 Drawing Sheets

(56) References Cited

U.S. PATENT DOCUMENTS

| | | | | |
|---|---|---|---|---|
| 6,037,555 | A * | 3/2000 | Castonguay | H01H 9/342 336/60 |
| 6,225,881 | B1 * | 5/2001 | Felden | H01H 71/04 335/172 |
| 2004/0074748 | A1 * | 4/2004 | Azzola | H01H 73/08 200/237 |
| 2005/0057333 | A1 * | 3/2005 | Subramanian | H01H 9/0264 335/202 |
| 2016/0260560 | A1 * | 9/2016 | Mishra | H01H 9/0264 |
| 2017/0098519 | A1 * | 4/2017 | Manthey | H01H 71/0264 |
| 2018/0323027 | A1 * | 11/2018 | Tomaselli | H01H 71/0228 |

* cited by examiner

MOLDED CASE CIRCUIT BREAKER WITH TERMINAL COVER HAVING EMBOSS GUIDES FOR CABLE BOX COVER ALIGNMENT AND FIXING

BACKGROUND

1. Field

Aspects of the present invention generally relate to a molded case circuit breaker configured to protect its ports and cables.

2. Description of the Related Art

For molded case circuit breakers of high amperes there is a family that has an electronic trip unit, commonly named as ETU, and one of its features are the communication ports from which one can obtain valuable data from the breaker. The cables that connects to the ports of the ETU are susceptible to be damaged, including the ports, so an additional cover must be implemented in the breaker in order to protect them.

The actual breakers with ETU use a terminal cover especially designed to let it pass the cables that connects to the ETU communication ports and pass over the lugs without touching them and a "cable box" cover that protect the cable of the ETU from external harm. However, the terminal cover is different than the one used in the breakers with a thermomagnetic trip unit (TMTU) and the cable box is assembled with only two screws, causing the cable box to fall when loosening them; so the design must hold the cover in position while putting out the screws or when mounting it to the breaker.

Therefore, there is a need for a better molded case circuit breaker.

SUMMARY

Briefly described, aspects of the present invention relate to a molded case circuit breaker configured to protect its ports and cables. The objective of the described invention is to provide a lug or terminal cover with emboss guides for a cable box cover alignment and fixing. Some molded case circuit breakers has an electronic trip unit (ETU) with one of its features being communication ports from which one can obtain valuable data from the breaker. The cables that connects to the ports of the ETU and the ports has an additional cover in order to protect them. In this invention a new design to an actual terminal cover is provided in order to be assembled in two different products, for the TMTU breakers and for the ETU breakers. As well, a redesign of a cable box cover is done to prevent it from falling after one takes out the screws from the new terminal cover, no matter how the breaker is mounted.

In accordance with one illustrative embodiment of the present invention, a molded case circuit breaker is provided. It comprises an electronic trip unit (ETU) including communication ports or a thermomagnetic trip unit (TMTU). The molded case circuit breaker further comprises a terminal cover configured to pass cables that connect to the communication ports of the ETU and pass the cables over lugs without touching the lugs. The molded case circuit breaker further comprises a cable box cover that protects the cables of the ETU from external harm. The terminal cover including an emboss fixture having emboss guides for alignment and fixing of the cable box cover. The electronic trip unit (ETU) or the thermomagnetic trip unit (TMTU) and the cable box cover are assembled with one or more screws. The cable box cover is prevented from falling after the one or more screws are taken out from the terminal cover regardless of how the circuit breaker is mounted.

In accordance with one illustrative embodiment of the present invention, a method of protecting ports and cables of a molded case circuit breaker is provided. The method comprises providing an electronic trip unit (ETU) including communication ports or a thermomagnetic trip unit (TMTU). The method further comprises providing a terminal cover configured to pass cables that connect to the communication ports of the ETU and pass the cables over lugs without touching the lugs. The method further comprises providing a cable box cover that protects the cables of the ETU from external harm. The terminal cover including an emboss fixture having emboss guides for alignment and fixing of the cable box cover. The electronic trip unit (ETU) or the thermomagnetic trip unit (TMTU) and the cable box cover are assembled with one or more screws. The cable box cover is prevented from falling after the one or more screws are taken out from the terminal cover regardless of how the circuit breaker is mounted.

DETAILED DESCRIPTION

Figure 1:
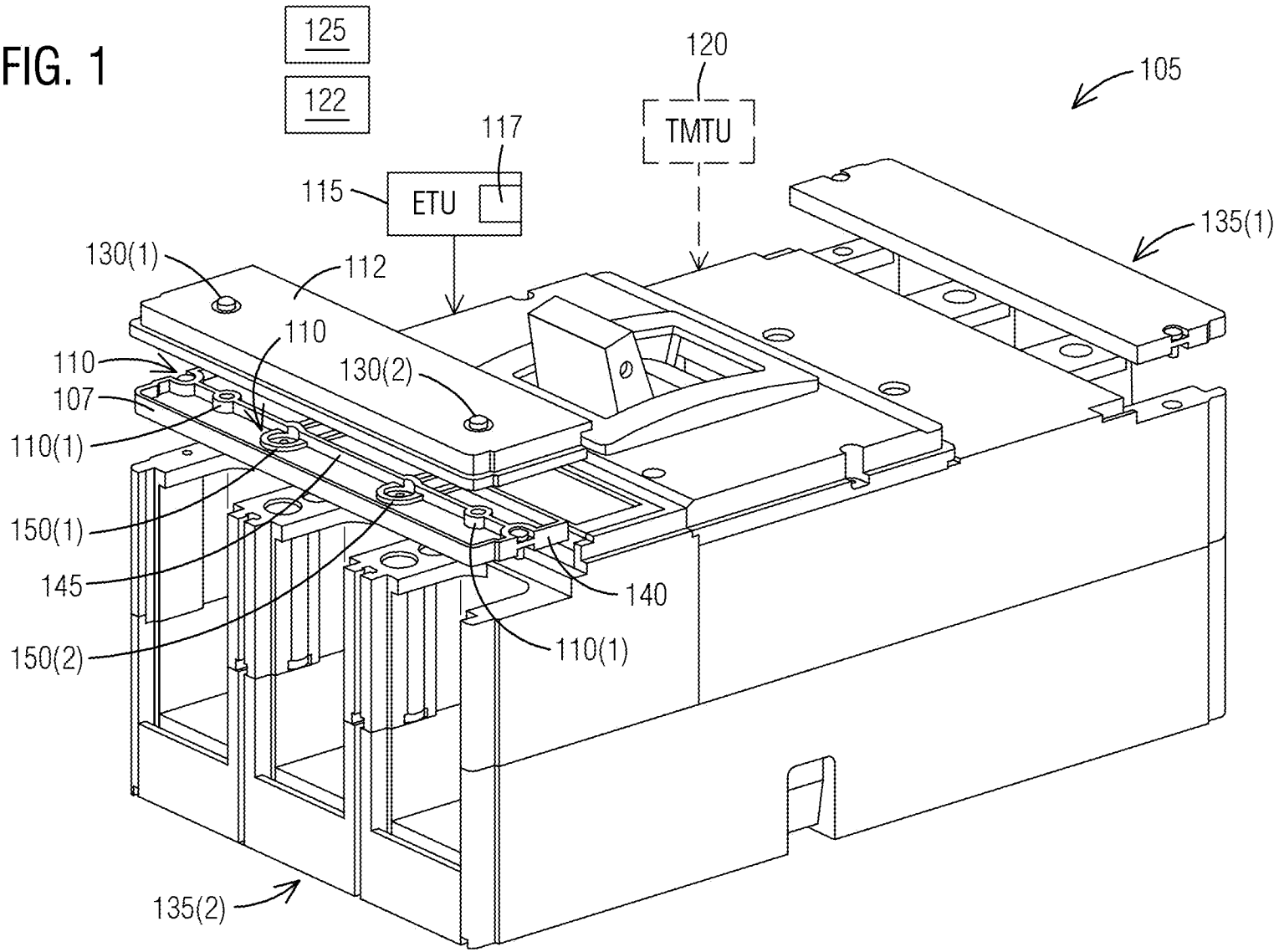
FIG. 1 illustrates a molded case circuit breaker including a lug or terminal cover with an emboss fixture having emboss guides for a cable box cover alignment and fixing in accordance with an exemplary embodiment of the present invention.

To facilitate an understanding of embodiments, principles, and features of the present invention, they are explained hereinafter with reference to implementation in illustrative embodiments. In particular, they are described in the context of a molded case circuit breaker. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

These and other embodiments of the molded case circuit breaker according to the present disclosure are described below with reference to FIGS. 1-7 herein. Like reference numerals used in the drawings identify similar or identical elements throughout the several views. The drawings are not necessarily drawn to scale.

Consistent with one embodiment of the present invention, FIG. 1 represents a block diagram of a molded case circuit breaker 105 in accordance with an exemplary embodiment of the present invention. The molded case circuit breaker 105 protects the system from over temperature and short circuit current. These circuit breakers are applied in panelboards, switchboards, motor control centers, control panels, combination starters, individual enclosures, and bus duct plug-in units. Requirements are increasing for cost-effective and energy-efficient operation of the electrical power distribution. Whether in industrial applications, buildings, or infrastructure: as a modular, highly variable system, the range of 3VA molded case circuit breakers provides thoroughly reliable operator and plant protection while supporting every process phase—from planning to the operation of electrical power distribution. 3VA molded case circuit breakers are available in several series with IEC approval as well as in series that comply with the IEC60947 and the UL489 standards. The system offers the best preconditions for machine and switchgear manufacturers. They can use all the functions of the molded case circuit breakers for plants that are operated in Europe and in North America and be completely confident of full compliance with the standards.

The molded case circuit breaker 105 includes a lug or terminal cover 107 with emboss guides 110 for a cable box cover 112 alignment and fixing in accordance with an exemplary embodiment of the present invention.

The molded case circuit breaker 105 comprises an electronic trip unit (ETU) 115 including communication ports 117 or a thermomagnetic trip unit (TMTU) 120. The molded case circuit breaker 105 further comprises the terminal cover 107 configured to pass cables 122 that connect to the communication ports 117 of the ETU 115 and pass the cables 122 over lugs 125 without touching the lugs 125. The molded case circuit breaker 105 further comprises the cable box cover 112 that protects the cables 122 of the ETU 115 from external harm.

The electronic trip unit (ETU) 115 or the thermomagnetic trip unit (TMTU) 120 and the cable box cover 112 are assembled with one or more screws 130(1-2). The cable box cover 112 is prevented from falling after the one or more screws 130(1-2) are taken out from the terminal cover 107 regardless of how the molded case circuit breaker 105 is mounted.

In one embodiment, the electronic trip unit (ETU) 115 or the thermomagnetic trip unit (TMTU) 120 and the cable box cover 112 are assembled with only two screws 130. The terminal cover 107 is to be flipped for assembly of the cable box cover 112. The cable box cover 112 goes over the terminal cover 107. To complete the assembly the one or more screws 130(1-2) will tighten both the terminal cover 107 and the cable box cover 112.

The terminal cover 107 has a flat surface on one side and on the other side having an emboss fixture 110(1) that will hold the cable box cover 112 in position. For assembly, the terminal cover 107 is flipped to leave the emboss fixture 110(1) visible and assemble it to the circuit breaker 105 such that the emboss fixture 110(1) acts as a retainer. The emboss fixture 110(1) may be in the form of a snap-fit clip or in the form of a pin or in the form of a slider.

In one embodiment, the emboss fixture 110(1) is configured such that the terminal cover 107 and the cable box cover 112 are stackable with a flush fit. The terminal cover 107 and the cable box cover 112 are of a same shape such as a rectangular shape and are of same size in terms of a length and a width. The cable box cover 112 has a bigger depth than a depth of the terminal cover 107.

The emboss fixture 110(1) includes the emboss guides 110 with a boundary strip 140 along a border of the terminal cover 107. The emboss guides 110 further include a divider strip 145 dividing the terminal cover 107 in half along its length. The boundary strip 140 and the divider strip 145 has openings for screws to go through. The emboss guides 110 further includes first and second strips 150(1-2) running perpendicular to the divider strip 145 and located close to one another near the center of the terminal cover 107. The first and second strips 150(1-2) having a first height which is less than a second height of the divider strip 145.

In one embodiment, the molded case circuit breaker 105 has a line side 135(1) and a load side 135(2). The terminal cover 107 and the cable box cover 112 are located on the load side 135(2) of the molded case circuit breaker 105.

In this invention a new design to the terminal cover 107 is provided in order to be assembled in two different products, for the TMTU breakers and for the ETU breakers. As well, a redesign of the cable box cover 112 is done to prevent it from falling after one takes out the screws 130 from the terminal cover 107, no matter how the breaker 105 is mounted. In this way, the molded case circuit breaker 105 is configured to protect its ports and cables as the terminal cover 107 with the emboss guides 110 is provided for the cable box cover 112 alignment and fixing.

Figure 2:
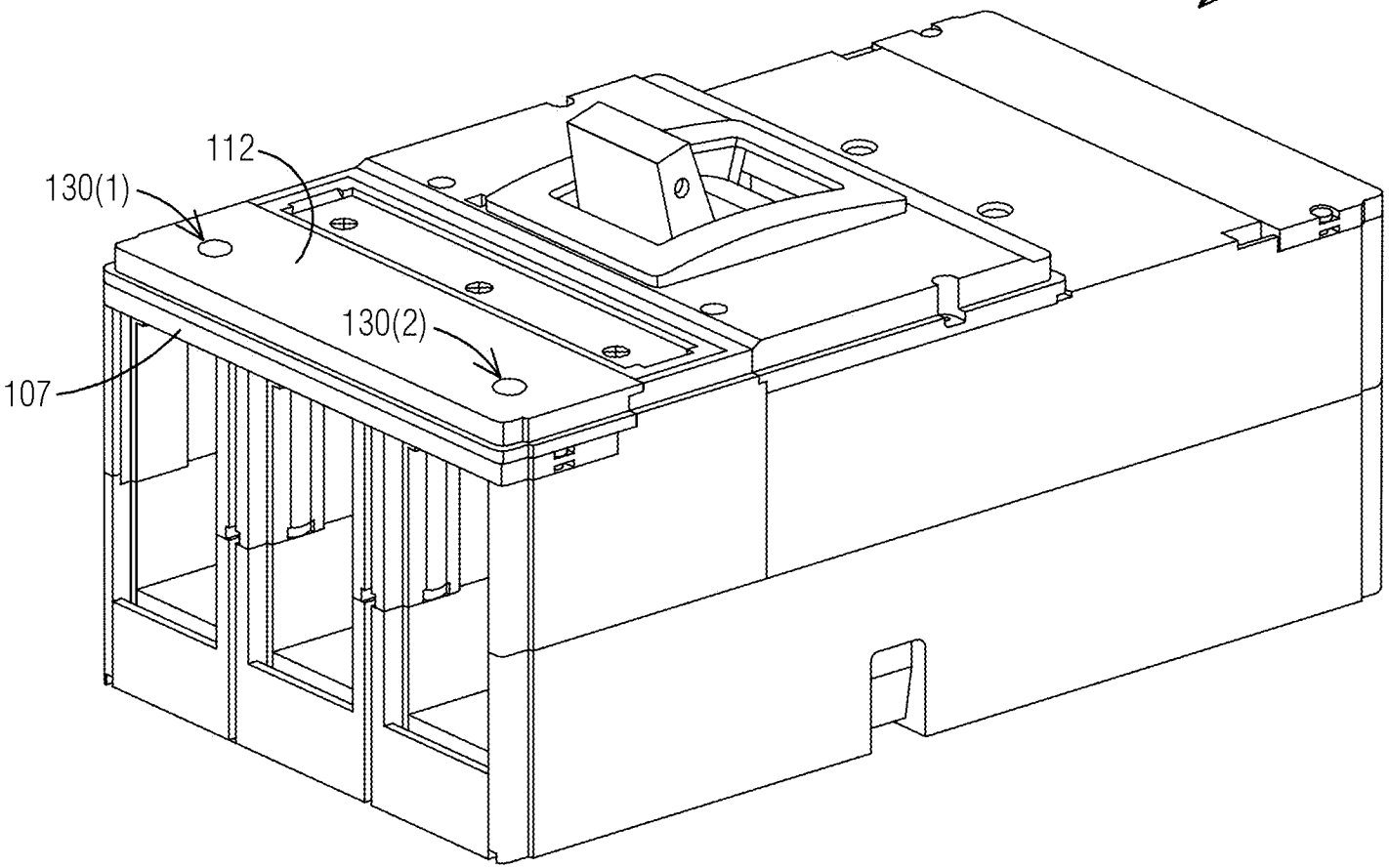
FIG. 2 illustrates an assembly with two screws that tightens both covers of FIG. 1 in accordance with an exemplary embodiment of the present invention.

Referring to FIG. 2, it illustrates an assembly with two screws that tightens both covers 107, 112 of FIG. 1 in accordance with an exemplary embodiment of the present invention. The emboss fixture 110(1) causes the cable box cover 112 to not fall when loosening them so there is no need to hold the terminal cover 107 in position while putting out the screws 130(1-2) or when mounting it to the breaker 105. The emboss fixture 110(1) may be in the form of a snap-fit clip or in the form of a pin or in the form of a slider.

The lug or terminal cover 107 could be made of BMC 1412A Shulman (unsaturated polyester composite grade, reinforced with glass fiber and mineral filler). The cable box cover 112 could be made of Lexan EXL5689 Sabic (polycarbonate resin). The circuit breaker 105 may be classified as a MCCB (Molded Case Circuit Breaker) which is a circuit breaker with a current path made of copper alloys, a switching mechanism made of steel and a case made of different molded compounds.

Figure 3:
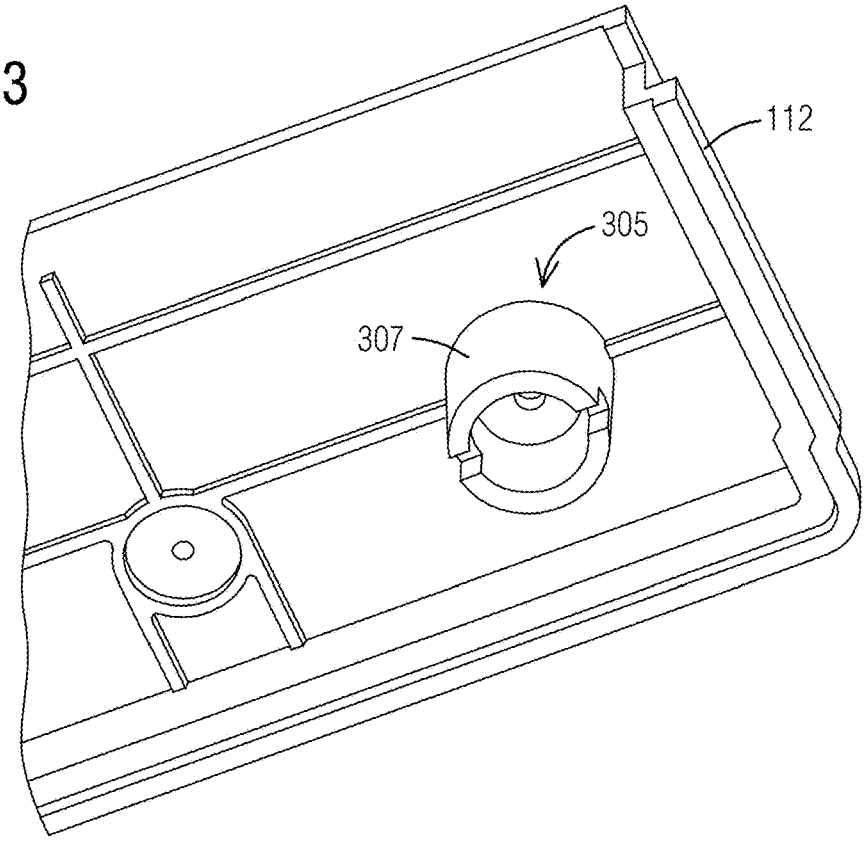
FIGS. 3 and 4 illustrate an emboss fixture in the form of a pin in accordance with an exemplary embodiment of the present invention.
Figure 4:
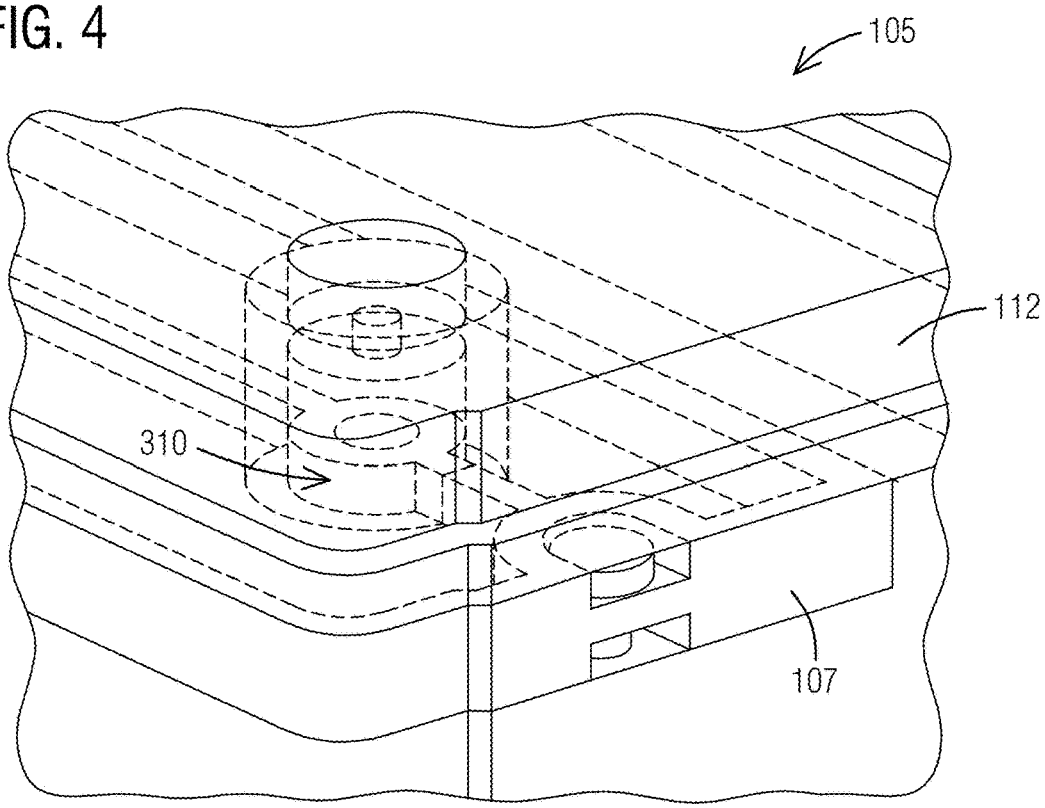

Turning now to FIGS. 3 and 4, they illustrate an emboss fixture 305 in the form of a pin in accordance with an exemplary embodiment of the present invention. In FIG. 3, the emboss fixture 305 in the form of the pin includes a female emboss 307 in the cable box cover 112. The emboss fixture 305 in the form of the pin further includes a metallic insert 310 in the terminal cover 107.

Figure 5:
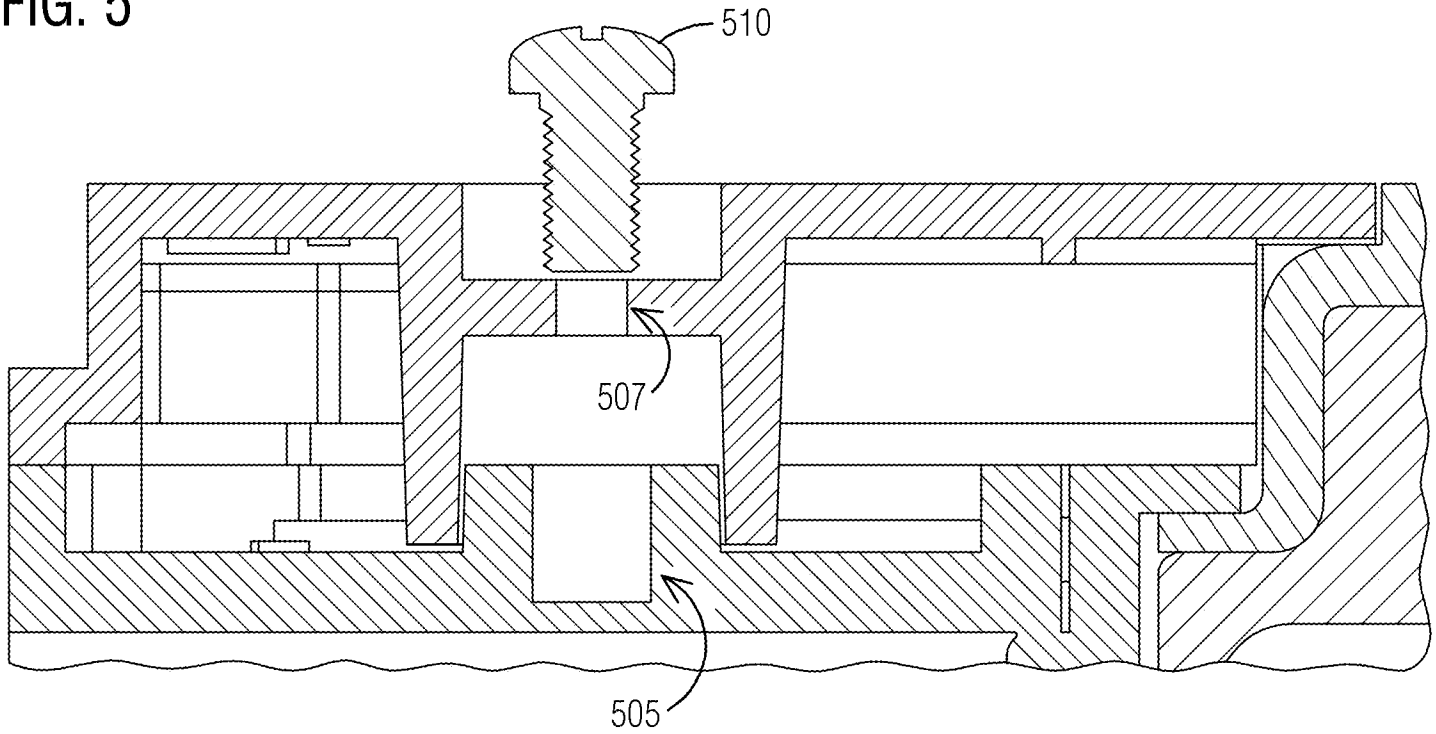
FIG. 5 illustrates a pin embodiment (male emboss and female emboss) of an emboss fixture in accordance with an exemplary embodiment of the present invention.

As seen in FIG. 5, it illustrates a pin embodiment (a male emboss 505 and a female emboss 507) of an emboss fixture in accordance with an exemplary embodiment of the present invention. The female emboss 507 on the cable box cover 112 will fit against the male emboss 505 with a metallic insert on the terminal cover 107 and then the cable box cover 112 will be fixed with two screws (one screw 510 is shown).

Figure 6:
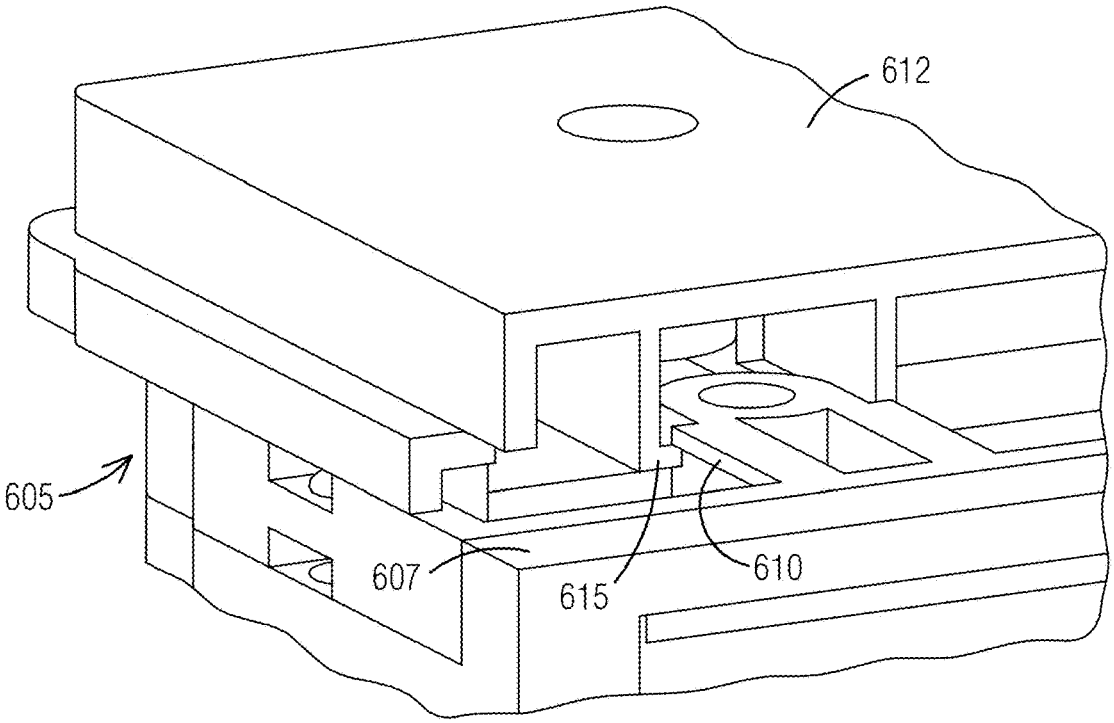
FIG. 6 illustrates an emboss fixture in the form of a slider in accordance with an exemplary embodiment of the present invention.

As shown in FIG. 6, it illustrates an emboss fixture in the form of a slider 605 in accordance with an exemplary embodiment of the present invention. A terminal cover 607 comprises sliding rails 610 and a cable box cover 612 comprises sliding rails 615. The cable box cover 612 would be positioned on the terminal cover 607 using sliding rails 610, 615 on both covers and then fixed in place with two screws (not shown).

Figure 7:
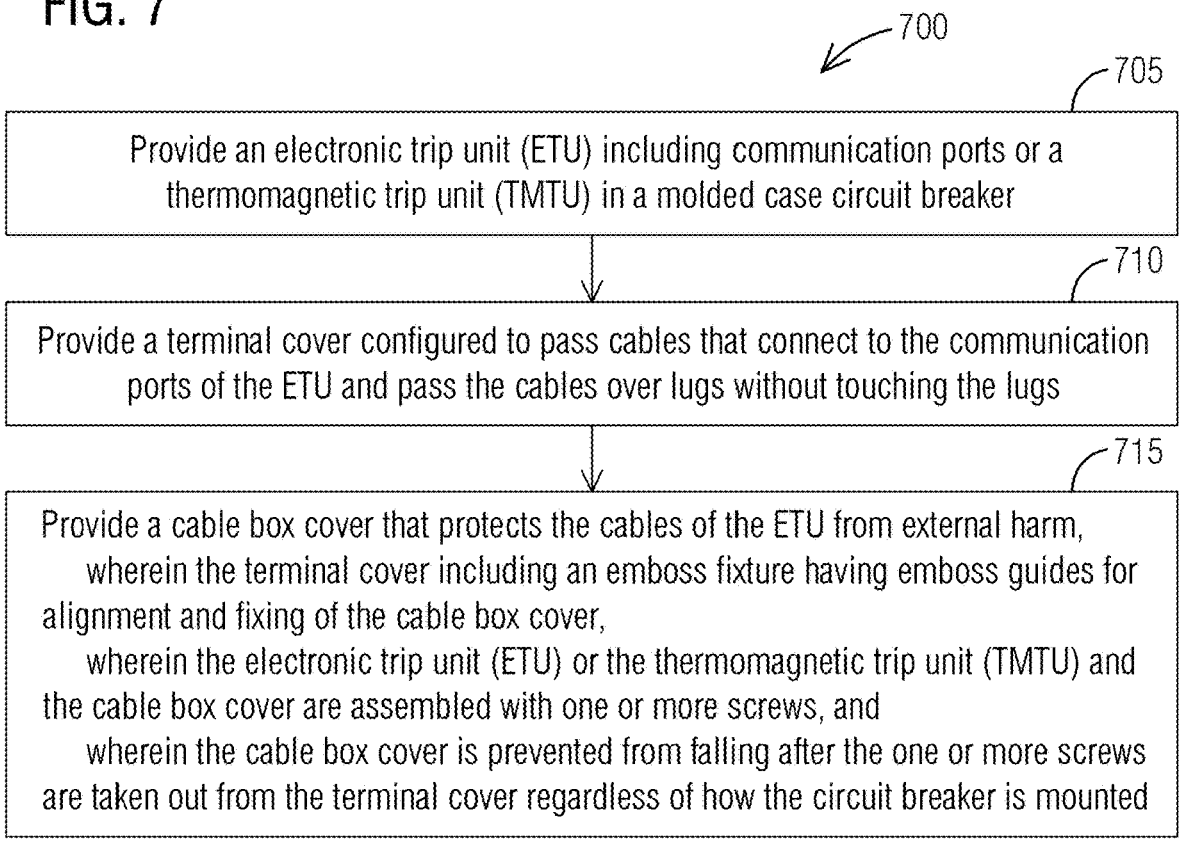
FIG. 7 illustrates a schematic view of a flow chart of a method of protecting ports and cables of a molded case circuit breaker in accordance with an exemplary embodiment of the present invention.

In FIG. 7, it illustrates a schematic view of a flow chart of a method 700 of protecting ports and cables of the molded case circuit breaker 105 in accordance with an exemplary embodiment of the present invention. Reference is made to the elements and features described in FIGS. 1-6. It should be appreciated that some steps are not required to be performed in any particular order, and that some steps are optional.

The method 700 comprises a step 705 of providing an electronic trip unit (ETU) including communication ports or a thermomagnetic trip unit (TMTU). The method 700 further comprises a step 710 of providing a terminal cover configured to pass cables that connect to the communication ports of the ETU and pass the cables over lugs without touching the lugs. The method 700 further comprises a step 715 of providing a cable box cover that protects the cables of the ETU from external harm. The electronic trip unit (ETU) or the thermomagnetic trip unit (TMTU) and the cable box cover are assembled with one or more screws. The cable box cover is prevented from falling after the one or more screws are taken out from the terminal cover regardless of how the circuit breaker is mounted.

While a MCCB (Molded Case Circuit Breaker) is described here a range of one or more other number of circuit breakers or other forms of circuit interrupters are also contemplated by the present invention. For example, other types of circuit breakers or circuit interrupters may be implemented based on one or more features presented above without deviating from the spirit of the present invention.

The techniques described herein can be particularly useful for circuit breakers or circuit interrupters including an electronic trip unit (ETU) or a thermomagnetic trip unit (TMTU). While particular embodiments are described in terms of specific configuration of trip units, the techniques described herein are not limited to such a limited configuration but can also be used with other configurations and types of circuitry.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A molded case circuit breaker, comprising:

an electronic trip unit (ETU) including communication ports or a thermomagnetic trip unit (TMTU);

a terminal cover; and a cable box cover that protects the cables of the ETU from external harm, wherein the terminal cover including an emboss fixture having emboss guides for alignment and fixing of the cable box cover, wherein the electronic trip unit (ETU) or the thermomagnetic trip unit (TMTU) and the cable box cover are assembled with one or more screws, wherein the cable box cover is prevented from falling after the one or more screws are taken out from the terminal cover regardless of how the circuit breaker is mounted, wherein the terminal cover having a flat surface on one side and on the other side having the emboss fixture that is configured to hold the cable box cover in position, wherein for assembly the terminal cover is flipped to leave the emboss fixture visible and assemble it to the circuit breaker such that the emboss fixture acts as a retainer, and wherein the emboss fixture is in the form of a pin including a male emboss and a female emboss such that the female emboss on the cable box cover will fit against the male emboss with a metallic insert on the terminal cover or wherein the emboss fixture is in the form of a slider such that the terminal cover comprises sliding rails and the cable box cover comprises sliding rails in that the cable box cover would be positioned on the terminal cover using the sliding rails of the terminal cover and the sliding rails of the cable box cover.

2. The molded case circuit breaker of claim 1, wherein the electronic trip unit (ETU) or the thermomagnetic trip unit (TMTU) and the cable box cover are assembled with only two screws.

3. The molded case circuit breaker of claim 1, wherein the terminal cover is to be flipped for assembly of the cable box cover.

4. The molded case circuit breaker of claim 3, wherein the cable box cover goes over the terminal cover.

5. The molded case circuit breaker of claim 4, wherein to complete the assembly the one or more screws will tighten both the terminal cover and the cable box cover.

6. The molded case circuit breaker of claim 1, wherein the emboss fixture is in the form of a snap-fit clip.

7. A method of protecting ports and cables of a molded case circuit breaker, the method comprising:

providing an electronic trip unit (ETU) including communication ports or a thermomagnetic trip unit (TMTU);

providing a terminal cover; and providing a cable box cover that protects the cables of the ETU from external harm, wherein the terminal cover including an emboss fixture having emboss guides for alignment and fixing of the cable box cover, wherein the electronic trip unit (ETU) or the thermomagnetic trip unit (TMTU) and the cable box cover are assembled with one or more screws, wherein the cable box cover is prevented from falling after the one or more screws are taken out from the terminal cover regardless of how the circuit breaker is mounted, wherein the terminal cover having a flat surface on one side and on the other side having the emboss fixture that is configured to hold the cable box cover in position, wherein for assembly the terminal cover is flipped to leave the emboss fixture visible and assemble it to the circuit breaker such that the emboss fixture acts as a retainer, and wherein the emboss fixture is in the form of a pin including a male emboss and a female emboss such that the female emboss on the cable box cover will fit against the male emboss with a metallic insert on the terminal cover or wherein the emboss fixture is in the form of a slider such that the terminal cover comprises sliding rails and the cable box cover comprises sliding rails in that the cable box cover would be positioned on the terminal cover using the sliding rails of the terminal cover and the sliding rails of the cable box cover.

8. The method of claim 7, wherein the electronic trip unit (ETU) or the thermomagnetic trip unit (TMTU) and the cable box cover are assembled with only two screws.

9. The method of claim 7, wherein the terminal cover is to be flipped for assembly of the cable box cover.

10. The method of claim 9, wherein the cable box cover goes over the terminal cover.

11. The method of claim 10, wherein to complete the assembly the one or more screws will tight both the terminal cover and the cable box cover.

12. The method of claim 7, wherein the emboss fixture is in the form of a snap-fit clip.

* * * * *